US010273730B2

(12) United States Patent
Liermann

(10) Patent No.: US 10,273,730 B2
(45) Date of Patent: Apr. 30, 2019

(54) ADJUSTABLE DOOR HINGE

(71) Applicant: SIMONSWERK GMBH, Rheda-Wiedenbrueck (DE)

(72) Inventor: Nicolas Liermann, Rheda-Wiedenbrueck (DE)

(73) Assignee: Simonswerk GmbH, Rheda-Wiedenbrueck (DE)

( * ) Notice: Subject to any disclaimer, the term of this patent is extended or adjusted under 35 U.S.C. 154(b) by 13 days.

(21) Appl. No.: 15/353,999

(22) Filed: Nov. 17, 2016

(65) Prior Publication Data

US 2017/0152689 A1 Jun. 1, 2017

(30) Foreign Application Priority Data

Nov. 26, 2015 (DE) ..... 10 2015 120 542

(51) Int. Cl.

*E05D 7/04* (2006.01)
*E05D 3/02* (2006.01)
*E05D 5/06* (2006.01)

(52) U.S. Cl.

CPC ..... *E05D 7/0423* (2013.01); *E05D 3/02* (2013.01); *E05D 7/0415* (2013.01); *E05D 7/04* (2013.01); *E05D 2005/067* (2013.01); *E05D 2007/0469* (2013.01); *E05D 2007/0476* (2013.01); *E05D 2007/0484* (2013.01); *E05D 2007/0492* (2013.01); *E05Y 2600/41* (2013.01)

(58) Field of Classification Search

CPC ..... E05D 7/04; E05D 7/0415; E05D 7/0054; E05D 7/0423

See application file for complete search history.

(56) References Cited

U.S. PATENT DOCUMENTS 9,145,721 B2 9/2015 Bartels et al.
9,670,707 B2 6/2017 Bartels et al.
2008/0271290 A1* 11/2008 Chen ..... E05D 7/04 16/238
2008/0271291 A1* 11/2008 Chen ..... E05D 7/0407 16/238
2008/0307606 A1* 12/2008 Karlsson ..... E05D 7/0415 16/243
2010/0115729 A1* 5/2010 Neukoetter ..... E05D 3/186 16/235

(Continued)

FOREIGN PATENT DOCUMENTS

AT 14999 U1 * 10/2016 ..... E05D 3/02
DE 4417039 A1 * 11/1995 ..... E05D 7/0423

(Continued)

OTHER PUBLICATIONS

European Search Report dated Mar. 30, 2017 in European Application No. 16198134.5 with English translation of relevant parts.

*Primary Examiner* — Emily M Morgan
(74) *Attorney, Agent, or Firm* — Collard & Roe, P.C.

(57) ABSTRACT

A door hinge has a first hinge part, a hinge bracket connected to the first hinge part to be pivotable about a rotational axis and a second hinge part connected to the hinge bracket The hinge bracket has an angled mounting section that is forcibly guided on a receiving block a first direction x and is lockable in place. The receiving block is adjustable in a second direction y in the second hinge part 4.

14 Claims, 6 Drawing Sheets

(56) References Cited

U.S. PATENT DOCUMENTS

| | | | | |
|---|---|---|---|---|
| 2010/0122431 | A1* | 5/2010 | Neukoetter | E05D 3/186 16/238 |
| 2012/0167342 | A1* | 7/2012 | Wu | E05D 7/0415 16/239 |
| 2014/0359973 | A1* | 12/2014 | Ng | E05D 7/00 16/225 |
| 2016/0032636 | A1* | 2/2016 | Dai | E05F 5/006 16/65 |
| 2017/0030122 | A1* | 2/2017 | Dreisewerd | E05D 3/18 |

FOREIGN PATENT DOCUMENTS

| | | | | |
|---|---|---|---|---|
| DE | 29802458 | U1 * | 4/1998 | E05D 5/06 |
| DE | 29802458 | U1 * | 6/1998 | E05D 5/06 |
| DE | 10 2009 020 626 | B3 | 10/2010 | |
| DE | 10 2013 112 645 | B3 | 10/2014 | |
| DE | 102015112640 | B3 * | 7/2015 | E05D 3/02 |
| DE | 10 2015 120 549 | B3 | 7/2016 | |
| EP | 2476836 | | 7/2012 | |
| EP | 2476836 | A1 * | 7/2012 | E05D 5/06 |
| EP | 2 725 175 | A2 | 4/2014 | |

* cited by examiner 1b
8
12
5
9
3b
3a
3
8
2
10
9
12
1a
1
1b
8
z
y
x
4
11b
14
13
15
14b
14a
14
11a

ADJUSTABLE DOOR HINGE

CROSS-REFERENCE TO A RELATED APPLICATION

The invention described and claimed hereinbelow is also described in German Patent Application DE 10 2015 120 542.4, filed on Nov. 26, 2015. This German Patent Application, subject matter of which is incorporated herein by reference, provides the basis for a claim of priority of invention under 35 U.S.C. 119(a)-(d).

BACKGROUND OF THE INVENTION

The invention relates to a door hinge comprising a first hinge part, a hinge bracket or arm that is connected to the first hinge part so as to be pivotable about a rotational axis, and a second hinge part which is detachably connected to the hinge bracket or arm, as further characterized and shaped hereinbelow. The inventive hinge bracket or arm, which is detachably connected to the second hinge part, is distinguishable from but related to a conventional hinge bracket, which conventional hinge bracket is also known to be referred to as a hinge tab.

Related door hinges are known from EP 2 476 836 A1.

To fasten a door leaf in a door opening, a first hinge part is usually fastened to a conventional hinge bracket or tab, which can pivot on the first hinge part, on the door leaf or on the door frame. The second hinge part for receiving the conventional hinge tab is then retained in the opposite part (door frame or door leaf). This installation usually takes place separately from each other. To establish a connection, the conventional hinge tab is inserted into the receiving device of the opposite hinge part and is fixed there.

Typically, two clamping plates are provided in the receiving hinge part, between which the conventional hinge tab is inserted and then locked in place by clamping the two clamping plates against each other. This clamping arrangement can additionally contain an adjustment mechanism.

In such an arrangement, however, it is disadvantageous that the part of the conventional hinge tab inserted between the two clamping plates must be very large to apply sufficient holding forces and, therefore, the conventional hinge tab must plunge very deeply into the receiving device. In addition, an adjustment in more than one spatial direction is very difficult to implement.

SUMMARY OF THE INVENTION

The present invention overcomes the shortcomings of known arts, such as those mentioned above.

The invention provides a stable door hinge having a first hinge part, a hinge bracket or arm, which preferably is "bowed" (hereinafter "hinge bracket"), which hinge bracket is connected to the first hinge part to be pivotable about a rotational axis, and a second hinge part which is connected to the hinge bracket, where the second hinge part requires only a low installation height on the door frame or on the door leaf. In addition, the invention provides for an advantageous multidimensional adjustment of the door hinge.

In the inventive door hinge, the hinge bracket has an angled mounting section which is forcibly guided on a receiving block in a first direction and is lockable in place. The receiving block itself is situated in the second hinge part to be adjustable in a second direction. In this case, angled means that a region of the hinge bracket which does not belong to the mounting section but is adjacent thereto forms an angle with the mounting section. This is advantageously implemented by bending a block-shaped crude part to form an L shape. Other shapes, such as, for example, a shape which can be achieved via metal casting or extruded profiles, can be utilized to realize the idea according to the invention. The first direction in which the mounting section is forcibly guided advantageously lies in the plane of the mounting section. The angled section adjacent thereto preferably extends approximately perpendicularly thereto. Due to the forcibly guided fastening of the mounting section on the receiving block, the fastening of the hinge bracket on the second hinge part is advantageously combined with a first adjustment. A large portion of the forces is already absorbed by the forcible guidance, and so the fastening and locking into place need act only in the first direction. The receiving block is situated to be adjustable as a whole, including, therefore, the hinge bracket connected thereto, in the second direction.

In an embodiment, the receiving section is designed to be flat. This has the advantage not only that the hinge bracket can be manufactured particularly cost-effectively from the usual sheet-shaped materials or extruded profiles which are already used for hinge tabs, but also that a particularly flat installation depth can be achieved in combination with the angled mounting section. The door leaf according to the invention can be designed in such a way that the flat mounting section extends approximately parallel to the front surface of the door frame or the door leaf, which encloses the receiving opening of the second hinge part. The hinge bracket, in the installed state, therefore extends into the recess only to the extent of the thickness of the flat mounting section, and so a particularly flat installation is possible here.

The receiving block has a step-shaped recess, into which the flat receiving section is inserted to be flush therewith, and against whose step edges the receiving section rests in a form-locked manner to form a sliding fit. The recess comprises a back surface, which substantially corresponds to the size of the receiving section. The step edges adjoin this back surface to be perpendicular thereto and extend up to a front surface of the receiving block. Preferably, the receiving section lies between the two step edges, without play, and is linearly guided thereon.

Preferably, the receiving section is locked in place on the receiving block by means of clamping screws. The clamping screws thereby advantageously pass through slots in the receiving section and are turned in internal threads in the receiving block. The screw head situated on the outer end of the clamping screws is tightened against the receiving block by tightening the clamping screws, and clamps the receiving section to be locked in place. Preferably, the heads of the clamping screws are accommodated to be recessed in the receiving section.

As an alternative to a manual adjustment, the receiving section can be adjustable in the first direction by manual adjustment, preferably using a cam. Thus, the adjustment and the displacement mechanics are independent of one another. Due to the cam, a highly precise adjustment of the door hinge in the first direction is possible. The cam is thereby operated in the same direction as the clamping screws, i.e., from the front side of the second hinge part.

The hinge bracket has a connecting section situated between the mounting section and a rotatable connection to the first hinge part. The rotatable connection can be provided, for example, by a rotational axis. The connecting section thereby preferably has a right angle with respect to the mounting section.

In an embodiment, the mounting section extends beyond the connecting section in the direction of the rotational axis. Thus, operating elements, for example, the clamping screws or a cam for adjusting the door hinge in the first direction, can be advantageously situated above and/or below the connecting section. The operating elements can therefore be particularly easily accessed. In addition, the mounting section is a larger lever for transferring tilting moments.

In an embodiment, the first hinge part comprises a projection, which protrudes over a main body in a stepped manner, for placement in a rabbet of a door leaf or a door frame. The rotational axis extends through this projection and, in the installed state, also through the rabbet of the door leaf or frame. Preferably, the connecting section is shaped as a circular arc, for example, a semicircular arc. Thus, the door hinge can be situated to be concealed between the door frame and the door leaf. A rabbet is a shoulder which extends, in a stepped manner, beyond the approximately rectangular, elongate main cross section of a door leaf (or a door frame). The rabbet is used for sealing and concealing the door gap, which results between the door leaf and the door frame in the closed state of the door.

In an embodiment of the door hinges for rebated doors, a great deal of effort may be required to situate the doors in a concealed manner. The rotational axis is moved into the rabbet to avoid a collision of the door rabbet with a stop surface on the associated door frame during an opening movement. This is not possible in the case of a conventional door hinge, however, which has hinge parts formed from approximately box-shaped receiving bodies that are inserted into the narrow side of the door leaf and into the associated inner surface of the door frame. To overcome the shortcoming, the inventive door hinge is provided with a projection to be situated in the door rabbet, so that the projection accommodates the pivot axis of the door hinge. For this purpose, the swivel mechanism is advantageously retained in the projection.

The projection may comprise an upper segment and a lower segment, which engage around the hinge bracket on the top side and the bottom side, respectively, and hold the rotational axis for the rotatable connection to the hinge bracket.

In the closed state of the door hinge, the connecting section of the hinge bracket shaped as a circular arc initially extends through the projection of the first hinge part and through the box-shaped receiving body. Both of these advantageously have a suitably shaped recess for this purpose. Next, the connecting section passes through the door gap and, on the opposite side, transitions into the mounting section. The door hinge equipped with a simple hinge bracket is therefore suitable for use in a concealed manner on a rebated door.

In an embodiment, the receiving block is adjusted in the second direction using a spindle drive. This second direction preferably extends perpendicular to the hinge axis and to the first direction. Therefore, the spindle drive can be situated approximately parallel to clamping screws, which are optionally present, for fixing the mounting section. Both elements can then be reached and operated from the same direction, i.e., the direction of the door gap.

In an embodiment, the second hinge part comprises a receiving element for fastening on a door frame or a door leaf, having an inner surface. The receiving block is forcibly guided in the second direction in the receiving element, in a sliding fit. In the installed state, the receiving element is usually inserted into an associated recess.

To form the sliding fit, the receiving block rests against the inner surface via an edge surface extending perpendicular to the second direction. Therefore, the sliding fit forming the forced guidance can be manufactured without any further components.

In an embodiment, the receiving block rests against the inner surface on all sides without interruption.

In another embodiment, an intermediate piece is situated in the receiving element to be displaceable along a third direction, and the receiving block is forcibly guided in the second direction on the intermediate piece, in a sliding fit. The receiving block thereby also has direct contact to at least parts of the inner surface for partially providing or assisting the forced guidance in the second direction. In this way, a three-dimensionally adjustable door hinge which does not require deep installation space can be manufactured particularly easily.

Advantageously, the intermediate piece is adjusted in the third direction by means of a wedge-assisted adjusting element. The wedge-assisted adjusting element is formed by a wedge-shaped piece, which is linearly displaceable by means of a spindle drive and is supported against an associated wedge-shaped surface of the intermediate piece. The wedge-assisted adjusting element is self-locking due to the use of a spindle drive. Therefore, the door hinge does not absolutely require locking means in the third direction. Preferably, the wedge-assisted adjusting element is used for height adjustment, and so the weight of the door hinge and/or the door fastened thereon acts as a restoring force opposed to the force induced by the wedge-assisted adjusting element. Alternatively, or additionally, a second wedge-assisted adjusting element can also be provided on the opposite side. This also provides for a more flexible use of the door hinge independently of the impact direction of the door leaf.

The invention also comprises a door hinge system for providing a door hinge comprising a first hinge part and a hinge bracket connected to the first hinge part to be pivotable about a rotational axis. The hinge bracket thereby has an angled mounting section on its end facing away from the first hinge part. The door hinge further includes a receiving block, on which the mounting section is forcibly guided in a first direction and is fastened to be locked in place. In addition, a fastening device is provided, in which the receiving block is adjustable in a second direction.

The fastening device alternatively comprises a first receiving element for fastening on a door frame or a door leaf, having a first inner surface, against which the receiving block directly rests, in a sliding fit, and is thereby forcibly guided in the second direction, or the fastening device comprises a second receiving element for fastening on a door frame or on a door leaf, having a second inner surface, in which an intermediate piece is situated so as to be displaceable along a third direction and the receiving block is forcibly guided in the second direction on the intermediate piece, in a sliding fit. The inventive door hinges may be manufactured in this way. Due to their modular design, it is possible to use the same main components for manufacturing two-dimensionally and three-dimensionally adjustable, flat door hinges. Due to the variable nesting of different forced guidance's acting perpendicular to each other, the adjustment possibilities can be particularly easily adapted to the requirements of the installation.

BRIEF DESCRIPTION OF THE DRAWING FIGURES

The invention is explained with reference to the following drawings, which merely show exemplary embodiments. Schematically in the drawings.

DETAILED DESCRIPTION OF THE PREFERRED EMBODIMENTS

The following is a detailed description of example embodiments of the invention depicted in the accompanying drawing. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
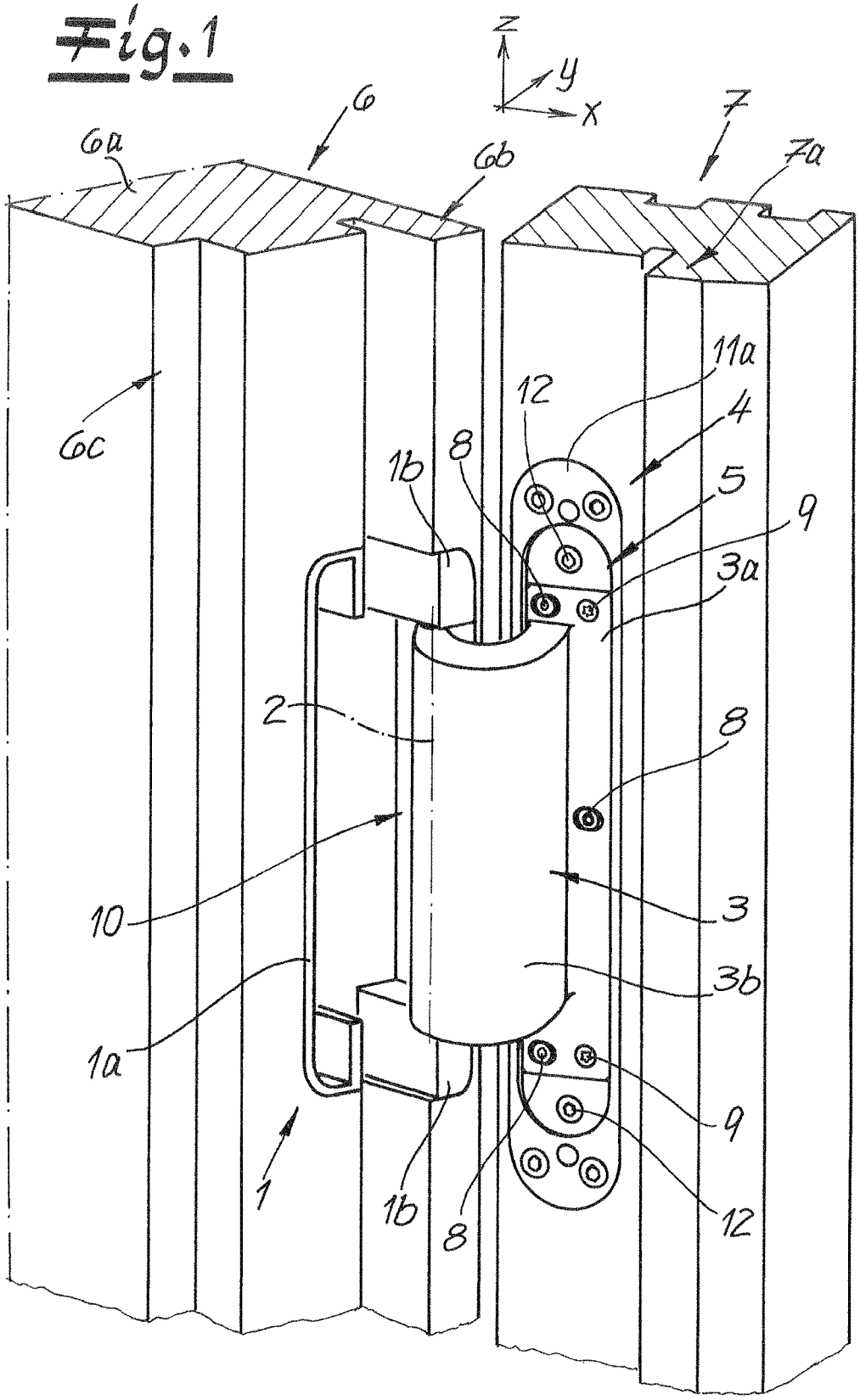
FIG. 1 depicts a door hinge according to an embodiment of the invention, in the installed state.

FIG. 1 presents a door hinge according to the invention, in an installed state. The door hinge comprises a first hinge part 1 and a hinge bracket 3, which is connected to the first hinge part 1 to be pivotable about a rotational axis 2. The hinge bracket 3 is connected to a second hinge part 4.

The hinge bracket 3 has an angled mounting section 3*a*, which is forcibly guided in a first direction x and is lockable in place on a receiving block 5. The receiving block 5 itself is adjustable in a second direction y in the second hinge part 4.

In the installed state shown, the first hinge part 1 is embedded in an associated recess in a door leaf 6. The door leaf 6 comprises a door leaf main body 6*a* and a door rabbet 6*b* protruding therefrom, on the narrow side. The first hinge part 1 is inserted via a main body 1*a* into the door leaf main body 6*a* and comprises a projection 1*b*, which extends into the door rabbet 6*b*. The projection 1*b* is formed by an upper segment and a lower segment which engage around the hinge bracket 3 on the top side and on the bottom side, respectively. The rotatable connection between the first hinge part 1 and the hinge bracket 3 is situated in the projection 1*b*, and so the rotational axis 2 extends through the projection 1*b* and the door rabbet 6*b*.

Figure 2:
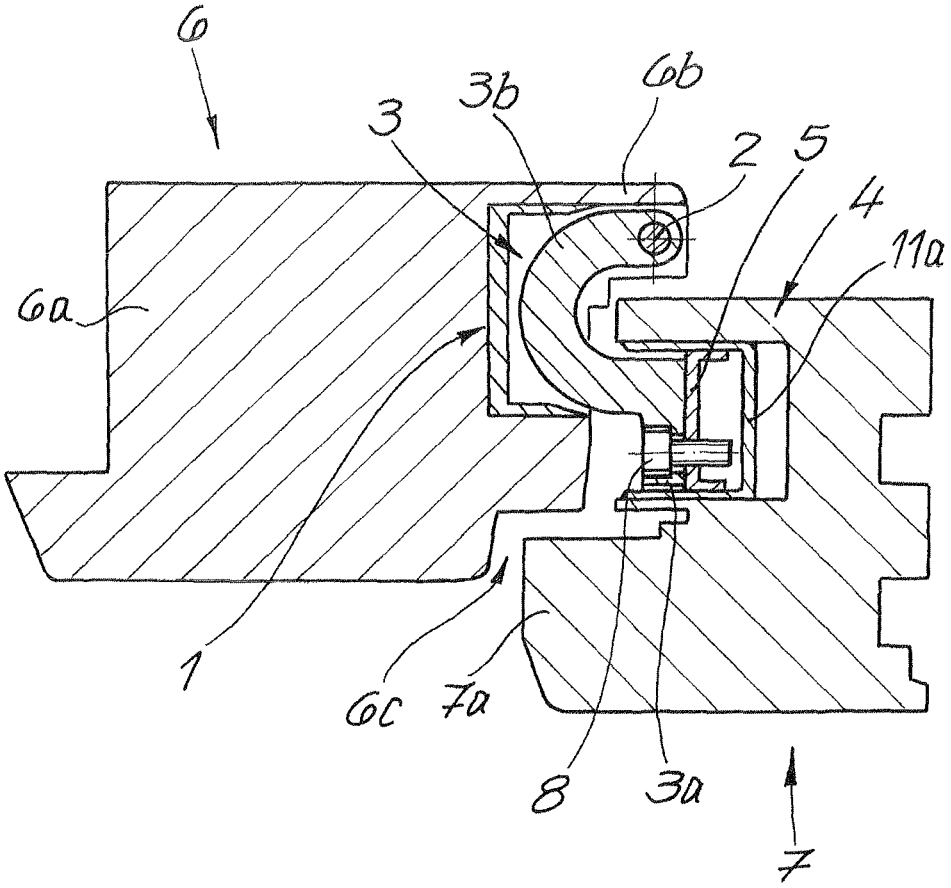
FIG. 2 depicts a horizontal section through the closed door hinge, in the embodiment depicted in FIG. 1.

The hinge bracket 3 comprises a connecting section 3*b*, which is shaped as a circular arc in the horizontal section represented in FIG. 2 and which connects the mounting section 3*a* to the rotatable connection to the first hinge part 1. In the closed state of the door hinge, which is shown in FIG. 2, the connecting section 3*b* initially extends through the projection 1*b* in the direction of the main body 1*a* of the first hinge part 1 and, there, passes through an associated hollow space. Next, the connecting section 3*b* extends through the door gap 10 situated between the door leaf 6 and the door frame 7 and transitions, at a right angle, into the mounting section 3*a*. Due to the positioning of the rotational axis 2, it is possible to pivot the door leaf 6 around the outer surface of the door frame 7 in a collision-free manner. The second hinge part 4 is inserted into an associated recess in the door frame 7. Furthermore, a jamb rabbet 7*a* is provided on the inside of the door frame 7 and interacts with an associated recess 6*c* of the door leaf.

The mounting section 3*a* is locked in place on the receiving block by three associated clamping screws 8, which pass through slots, and are adjusted in the first direction x (pressing direction) by use of two cams 9.

Figure 3:
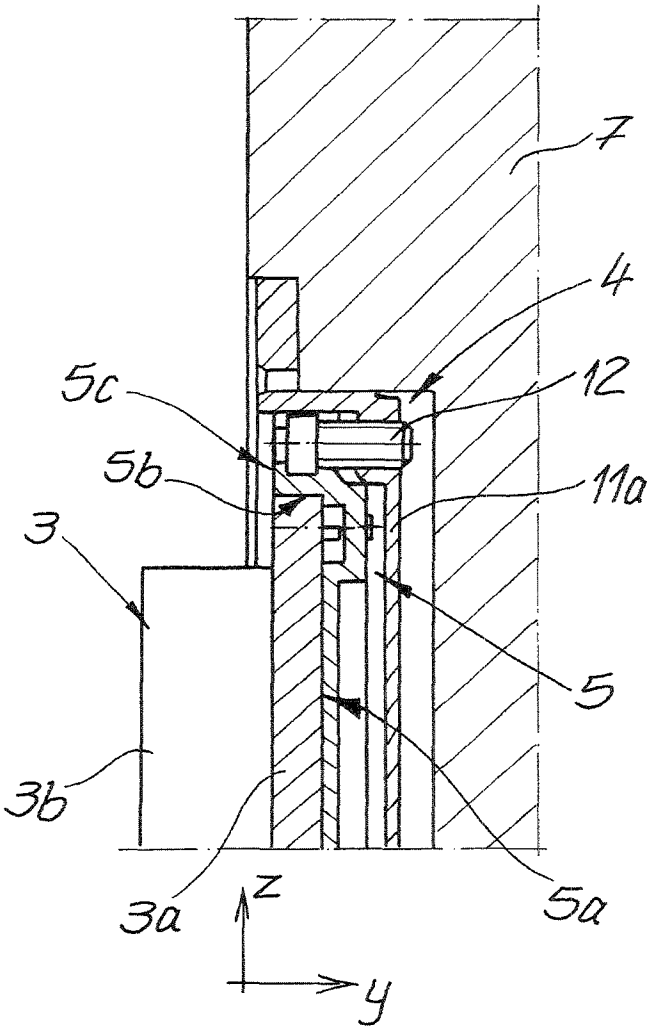
FIG. 3 depicts a vertical sectional view through the second hinge part of the door hinge depicted in FIG. 1.

It should be clear from FIG. 3 that the receiving block 5 has a stepped recess having a back surface 5*a* and two step edges 5*b*. The flat mounting section 3*a* is inserted into the recess to be flush with a front side 5*c* of the receiving block 5 and rests against the step edges 5*b* in a form-locked manner.

It also should be clear from the cross-sectional view that the receiving block 5 is forcibly displaceable, in a form-locked manner, in the second direction y on an inner surface of a first receiving element 11*a* which, in the exemplary embodiment, forms the second hinge part 4. The receiving block 5 is thereby adjustable in this direction by spindle drive 12.

Figure 4:
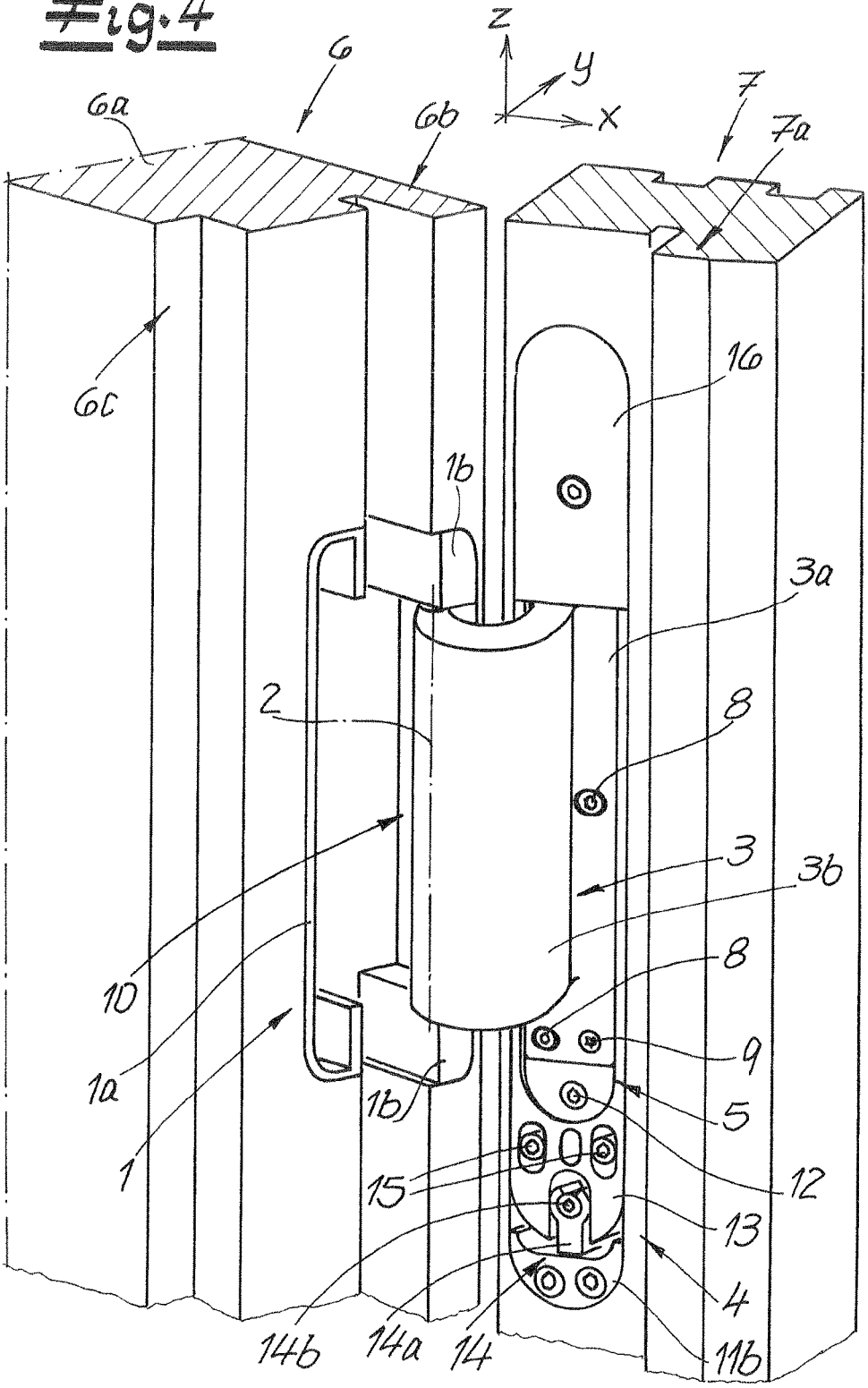
FIG. 4 depicts a door hinge according to another embodiment of the invention, in the installed state.
Figure 5:
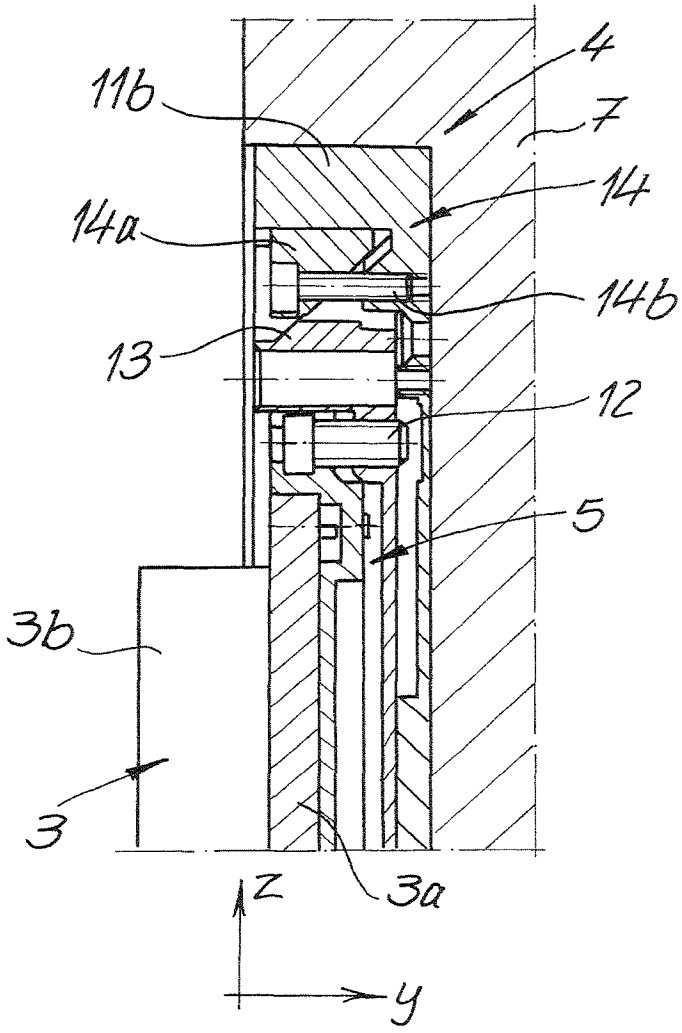
FIG. 5 depicts a vertical horizontal view through the second hinge part of the door hinge depicted in FIG. 4.

FIGS. 4 and 5 depict a three-dimensionally adjustable door hinge and correspond to the representations of the two-dimensionally adjustable door hinge in FIGS. 1 and 3. In contrast thereto, the second hinge part 4 comprises a second receiving element 11*b* having a second inner surface, in which an intermediate piece 13 is situated to be displaceable along a third direction z. The receiving block 5 is forcibly guided on the intermediate piece 13 in the second direction y. In FIG. 4, it is evident in the lower region of the second hinge part that the intermediate piece 13 can be moved in the third direction z by a wedge-assisted adjusting element 14. In addition, locking screws 15 are provided, which can pass through associated slots in the intermediate piece and lock the intermediate piece into place by clamping the intermediate piece against the second receiving element 11*b* in the third direction z.

In addition, a cover plate 16 is shown above the hinge bracket 3 on the second hinge part 4. The cover plate conceals and protects the mechanisms and adjustment settings lying behind it. A corresponding cover plate 16 also can be used in the lower region of the second hinge part and in the embodiment, according to FIGS. 1 to 3. The fastening of the cover plate 16 passes through the intermediate piece 13 through a slot and is connected to the second receiving element 11*b*.

The wedge-assisted adjusting element 14 is apparent in detail in the cross-sectional view of FIG. 5. The wedge-assisted adjusting element is formed by a wedge piece 14*a*, which is displaceable in the second direction y by a spindle drive 14*b*. The wedge-shaped piece 14*a* bears against an oblique wedge-shaped surface on an associated wedge-shaped surface of the intermediate piece 13.

Figure 6:
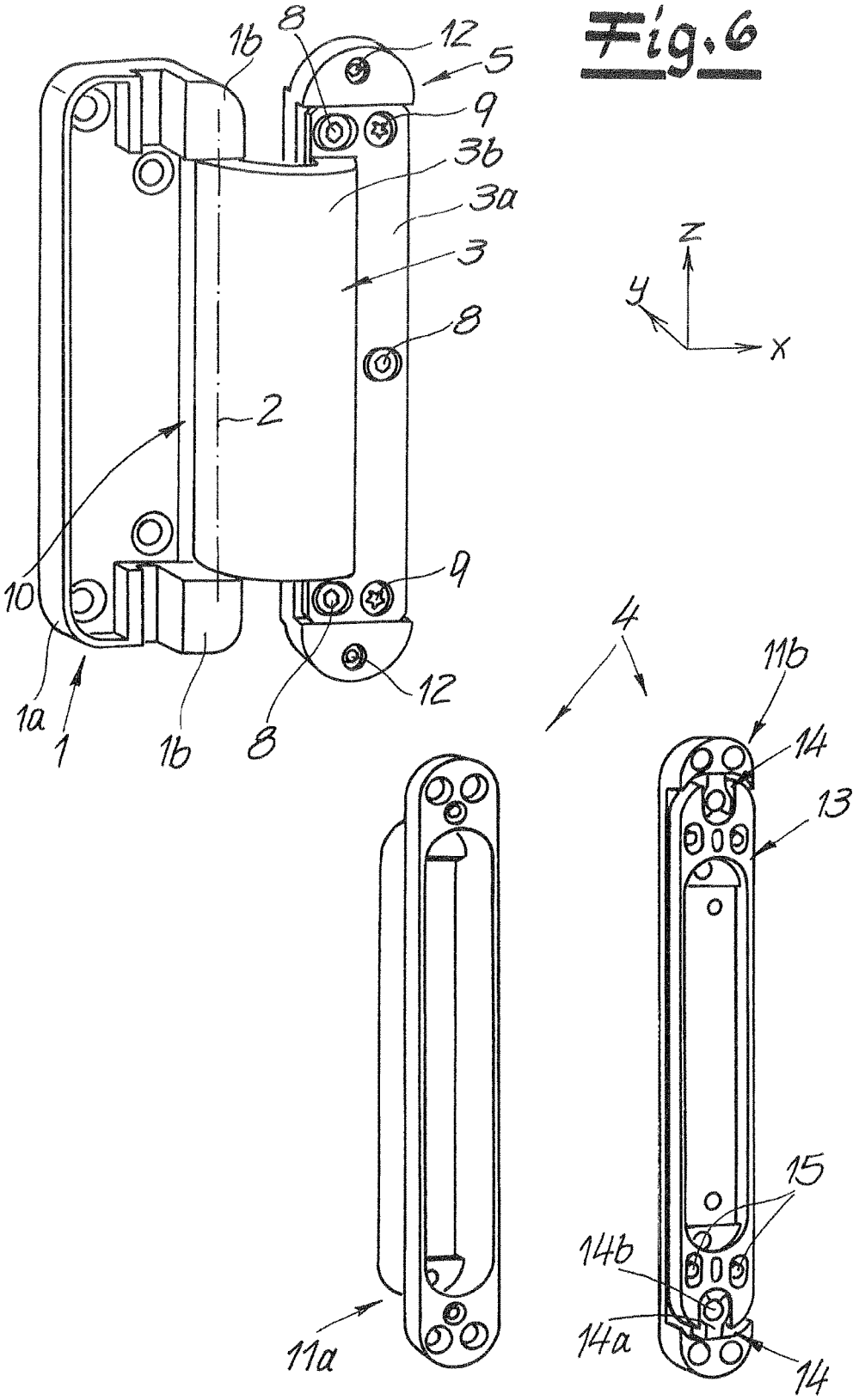
FIG. 6 depicts a door hinge system according to the invention.

The components of a door hinge system according to the invention are shown in FIG. 6. The door hinge system includes a first hinge part 1 having a hinge bracket 3, which is connected so as to be rotatable about a rotational axis 2. The hinge bracket 3 comprises an angled mounting section 3*a* on its end facing away from the first hinge part 1. The door hinge further includes a receiving block 5, on which the mounting section 3*a* is forcibly guided in a first direction x and is fastened to be locked in place. In addition, a fastening device is provided, in which the receiving block 5 is adjustable in a second direction y.

The fastening device alternatively comprises a first receiving element 11*a* for fastening on a door frame or on a door leaf, which provides a first inner surface, on which the receiving block 5 can be directly mounted in a sliding fit, to form a forced guidance in the second direction y.

Alternatively, the fastening device comprises a second receiving element 11*b*, in which an intermediate piece 13 is situated to be displaceable along a third direction z. The intermediate piece provides a second inner surface, on which the receiving block 5 can be mounted, in order to form a forced guidance along the second direction y.

As shown, the first, the second, and the third direction x, y and z, respectively, are each perpendicular to each other. In this case, the first direction x is referred to as the pressing direction, the second direction y is referred to as the lateral direction, and the third direction z is referred to as the vertical direction.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A door assembly comprising:

a door frame;

a door leaf; and a door hinge connecting the door leaf to the door frame, the door hinge comprising:

a first hinge part embedded in a recess in the door leaf;

a hinge bracket that is connected to the first hinge part to be pivotable about a rotational axis of the hinge bracket; and a second hinge part inserted into a recess in the door frame and being connected to the hinge bracket;

wherein the hinge bracket has an angled mounting section that is guided on a receiving block in a first direction (x) and is lockable in place with clamping screws;

wherein the receiving block is configured so as to be adjustable in a second direction (y) in the second hinge part;

wherein the second hinge part comprises a receiving element fastened on the door frame;

wherein the receiving element has an inner surface and wherein the receiving block is configured to be guided in the second direction (y) in the receiving element, in a sliding fit, and wherein an edge surface of the receiving block rests directly against the inner surface of the receiving element, the edge surface extending perpendicular to the second direction (y).

2. The door assembly according to claim 1, wherein the angled mounting section is flat.

3. The door assembly according to claim 2, wherein the receiving block has a stepped recess having step edges, into which the flat, angled mounting section is inserted to be flush therewith; and wherein the mounting section rests against the step edges to form a sliding fit.

4. The door assembly according to claim 1, wherein the angled mounting section is adjusted in the first direction using a cam.

5. The door assembly according to claim 1, wherein the hinge bracket has a connecting section situated between the angled mounting section and a rotatable connection to the first hinge part.

6. The door assembly according to claim 5, wherein the connecting section is disposed at a right angle with respect to the angled mounting section.

7. The door assembly according to claim 5, wherein the angled mounting section extends beyond the connecting section in the direction of the rotational axis.

8. The door assembly according to claim 5, wherein the first hinge part has a projection that extends beyond a main body of the first hinged part in a stepped manner and is situated in a rabbet of the door leaf or of a door frame, wherein the rotational axis extends through the projection; and wherein the connecting section is designed at least in part in a shape of a circular arc.

9. The door assembly according to claim 1, further comprising a spindle drive for adjusting the receiving block in the second direction (y).

10. The door assembly according to claim 1, wherein the receiving block rests against a periphery of the inner surface.

11. The door assembly according to claim 9, wherein an intermediate piece is situated in the receiving element and is configured to be displaceable along a third direction (z); and wherein the receiving block is configured to be guided in the second direction (y) on the intermediate piece, in a sliding fit.

12. The door assembly according to claim 11, wherein the intermediate piece is adjusted in the third direction (z) using a wedge-assisted adjusting element.

13. A door hinge system including a door hinge, wherein the door hinge comprises:

a first hinge part;

a hinge bracket that is connected to the first hinge part to be pivotable about a rotational axis, wherein the hinge bracket comprises an angled mounting section on a bracket end facing away from the first hinge part;

a receiving block;

wherein the angled mounting section is configured to be guided on the receiving block in a first direction (x) and fastened to be lockable in place; and a receiving element;

wherein the receiving block is configured to be adjustable in the receiving element in a second direction (y);

wherein the receiving element comprises either:

a first receiving element for fastening on a door frame or on a door leaf, where the first receiving element has a first inner surface, against which the receiving block directly rests, and the receiving block is surrounded by the inner surface of the receiving element, in a sliding fit, and can thereby be guided by the inner surface in the second direction (y); or a second receiving element for fastening on a door frame or on a door leaf, where the second receiving element has a second inner surface, in which an intermediate piece is situated to be displaceable along a third direction (z), where the receiving block is configured to be guided in the second direction on the intermediate piece, and the receiving block is surrounded by the intermediate piece, in a sliding fit.

14. A door hinge, comprising:

a first hinge part;

a hinge bracket that is connected to the first hinge part to be pivotable about a rotational axis of the hinge bracket; and a second hinge part that is connected to the hinge bracket;

wherein the hinge bracket has an angled mounting section that is guided on a receiving block in a first direction (x) and is lockable in place with clamping screws;

wherein the receiving block is configured so as to be adjustable in a second direction (y) in the second hinge part;

wherein the second hinge part comprises a receiving element configured for fastening on a door frame or a door leaf;

wherein the receiving element has an inner surface on which he receiving block is mounted so that the receiving block is surrounded by the receiving element, and wherein the receiving block is configured to be guided in the second direction (y) in the receiving element, in a sliding fit, and wherein an edge surface of the receiving block rests directly against the inner surface of the receiving element, the edge surface extending perpendicular to the second direction (y).

* * * * *